United States Patent [19]

Clampitt et al.

[11] Patent Number: 4,623,447

[45] Date of Patent: Nov. 18, 1986

[54] BREAKING MIDDLE PHASE EMULSIONS

[75] Inventors: Bert H. Clampitt; Asoke K. Deysarkar, both of Katy; Thomas D. Westmoreland, Jr., Conroe, all of Tex.

[73] Assignee: Pennzoil Company, Houston, Tex.

[21] Appl. No.: 761,835

[22] Filed: Aug. 2, 1985

[51] Int. Cl.[4] ..... C10G 33/00; B01D 3/00; B01D 17/04

[52] U.S. Cl. ..... 208/187; 208/184; 208/188; 208/364; 208/180; 203/14; 203/73; 203/79; 252/328; 252/346; 252/347

[58] Field of Search ..... 208/187, 188, 364, 180, 208/184; 203/14, 73, 79; 252/328, 346, 347

[56] References Cited

U.S. PATENT DOCUMENTS

| | | | |
|---|---|---|---|
| 1,214,259 | 10/1909 | Artmann | 208/187 |
| 1,268,721 | 6/1918 | Jensen | 252/346 |
| 1,299,590 | 4/1919 | McKibben | 252/347 |
| 1,315,623 | 9/1919 | Cobb | 208/188 |
| 1,386,077 | 8/1921 | Rudigier | 208/187 |
| 1,419,610 | 6/1922 | Brown | 208/187 |
| 1,649,104 | 11/1927 | Egloff et al. | 196/5 |
| 1,797,715 | 3/1931 | Carpenter et al. | 196/5 |
| 1,848,125 | 3/1932 | Grisbaum | 208/187 |
| 1,963,488 | 6/1934 | Ellsberg | 196/5 |
| 1,979,234 | 10/1934 | Rosenburg | 208/364 |
| 2,368,497 | 1/1945 | Shipley | 203/14 |
| 2,770,577 | 11/1956 | Stossel | 196/18 |
| 3,152,067 | 10/1964 | Akers et al. | 252/328 |
| 3,294,676 | 12/1966 | Brunner | 208/187 |
| 3,326,799 | 6/1967 | Demeester | 208/364 |
| 3,448,016 | 6/1969 | Hoppe | 208/14 |
| 3,468,789 | 9/1969 | Balassa | 208/188 |
| 3,565,791 | 2/1971 | Urquhart et al. | 208/188 |
| 3,585,124 | 6/1971 | Myers | 203/73 |
| 3,597,331 | 8/1971 | Ogawa et al. | 203/43 |
| 3,840,468 | 10/1974 | Rogenhoffer | 252/358 |
| 3,985,642 | 10/1976 | Friel et al. | 208/180 |
| 4,021,399 | 5/1977 | Hunter et al. | 260/29.6 |
| 4,022,688 | 5/1977 | Wikholm | 252/346 |
| 4,029,570 | 6/1977 | Coffman et al. | 208/188 |
| 4,071,438 | 1/1978 | O'Blasny | 208/180 |
| 4,073,719 | 2/1978 | Whisman et al. | 208/180 |
| 4,229,261 | 10/1980 | Heck et al. | 203/14 |
| 4,261,812 | 4/1981 | Newcombe | 208/188 |
| 4,370,238 | 1/1983 | Tackett, Jr. | 210/639 |
| 4,374,734 | 2/1983 | Newcombe | 210/708 |
| 4,415,443 | 11/1983 | Murphy | 203/73 |
| 4,444,654 | 4/1984 | Cargle et al. | 208/188 |
| 4,446,054 | 5/1984 | Bessler | 252/344 |
| 4,448,708 | 5/1984 | Killat | 252/344 |

FOREIGN PATENT DOCUMENTS

| | | | |
|---|---|---|---|
| 2153162 | 5/1973 | Fed. Rep. of Germany | 208/187 |
| 2359205 | 6/1974 | Fed. Rep. of Germany | 202/14 |
| 0054203 | 5/1978 | Japan | 203/14 |
| 1193778 | 6/1970 | United Kingdom | 252/358 |

*Primary Examiner*—Andrew H. Metz
*Assistant Examiner*—Helane Myers
*Attorney, Agent, or Firm*—Lowe,Price,LeBlanc, Becker & Shur

[57] ABSTRACT

Middle phase emulsions are broken by subjecting the emulsion to a first atmospheric distillation step to remove water, followed by a second vacuum distillation step to recover oil. The residue contains the surfactant. The atmospheric distillation is generally carried out by steam distillation.

9 Claims, No Drawings

BREAKING MIDDLE PHASE EMULSIONS

FIELD OF THE INVENTION

The invention relates to a method of breaking a middle phase oil and water emulsion by sequential distillation.

BACKGROUND OF THE INVENTION

Since 1927, the surfactant flooding process has been the most prevalent method of achieving enhanced oil recovery from underground wells. Generally, easily recoverable oil is first removed from an underground reservoir, most commonly by water flooding. The enhanced recovery process is then performed to recover the remainder of the oil. Since so much water has been introduced into the well, the recovered product will generally contain a significant amount of water. To perform the enhanced recovery, surfactants are added to the reservoir to lower the surface tension between the water and oil contained therein. The surfactant recovery process results in a three-phase system, a top oil phase, a lower brine water phase, and a middle phase water and oil emulsion, the latter comprising about 40% of the total. Since significant amounts of oil and surfactants are contained in this middle phase emulsion, prior art attempts have been made to break the emulsion to recover the oil and surfactants therefrom.

Prior art methods of breaking middle phase emulsions are usually carried out by the addition of chemical demulsifiers to the emulsion. U.S. Pat. No. 4,029,570, issued June 14, 1977, discloses a method of breaking an oil-water-sulfonate middle phase emulsion by mixing the emulsion with brine, agitating the mixture, and separating the crude oil therefrom.

U.S. Pat. No. 4,261,812, issued Apr. 14, 1981, discloses a method of breaking an oil and water emulsion by adding additional surface active agents, preferably additional petroleum sulfonates, and subjecting the emulsion to traditional emulsion breaking techniques, such as the addition of brine. U.S. Pat. No. 4,374,734 discloses a similar process wherein the emulsion is treated with brine and a polyol or quaternary ammonium compound or both.

Some prior art methods of oil and water separation have involved physical methods. U.S. Pat. No. 4,071,438, issued Jan. 31, 1978, involves a method of reclaiming or re-refining waste oils involving a dehydrating step and a subsequent vacuum distillation step.

U.S. Pat. No. 3,840,468, issued Oct. 8, 1974, discloses a method for separating emulsions of waste oil and water by a falling-film evaporation process.

U.S. Pat. No. 4,370,238, issued Jan. 25, 1983, discloses a method for the removal of water from a surfactant containing crude oil comprising a water removal step, and a step to separate the oil from the surfactants wherein the oil is separated by an alcohol phase separation and the alcohol is then distilled so that surfactants may be recovered. However, none of the processes involving physical separation steps have been used to separate middle phase emulsions.

There remains a need in the art for an efficient and economical process to separate middle phase emulsions and recover the valuable components contained therein.

SUMMARY OF THE INVENTION

It is an object of the present invention to provide a method of breaking a middle phase emulsion using sequential distillation steps.

Another object of the present invention is to provide a method of performing enhanced oil recovery by breaking a middle phase emulsion to recover water, oil and surfactants.

A still further object of the present invention is to provide a method for breaking a middle phase emulsion without the addition of surfactants or other chemicals to the emulsion.

Other objects and advantages of the present invention will become apparent as the description thereof proceeds.

In satisfaction of the foregoing objects and advantages, there is provided by the present invention a novel method for breaking middle phase emulsions for enhanced oil recovery, the method comprising, subjecting the middle phase emulsion to an atmospheric distillation step to remove water therefrom, and then subjecting the distillation residue to vacuum distillation to remove the oil and recover the surfactant as a residue. This method allows recovery of water, oil and surfactants which may be reused in the oil recovery process, or further processed as separate products.

DESCRIPTION OF THE PREFERRED EMBODIMENTS

As indicated above, the present invention is directed to a method for breaking the middle phase emulsion by first subjecting to atmospheric distillation to remove water and then vacuum distillation to remove oil, thus leaving the surfactant as distillation residue. This method is found to be more advantageous than prior art chemical methods of breaking the middle phase emulsion because it does not require the addition of further chemicals to the emulsion, and provides an efficient enhanced oil recovery method.

As set forth hereinabove, the middle phase emulsion is produced as a result of an oil recovery process wherein water and surfactants are injected into underground oil reservoirs. This causes the contents of the reservoir to fractionate into three liquid fractions, a top oil fraction, a bottom water or brine fraction, and a middle phase emulsion. The middle phase emulsion is comprised of an emulsion of oil, water, and the added surfactants. The emulsion will usually contain about 10–50 wt. % water and about 10–50 wt. % of oil. The surfactant concentration may range from about 0.5 wt. % up to 50 wt. % of the total emulsion.

While a number of different surfactants are used in this process, the most common type are sulfonates, for example petroleum sulfonates. Thus, the middle phase emulsion will generally be composed of oil, water, and surfactant. The surfactant is any of the conventional surfactants used in processes for the recovery of oil. The surfactant can be nonionic, e.g., ethoxylated aliphatic alcohols, ethoxylated alkyl phenols and coconut diethanolamide; cationic, e.g., quaternary ammonium compounds, anionic, e.g., alkylaryl sulfonates, fatty alcohol sulfates, sulfated and sulfonated amides and amines, alkyl sulfonates, and sulfated and sulfonated esters and ethers; ampholytic, e.g., cetylaminoacetic acid; or mixtures of surfactants. The invention is especially applicable to crude oil containing petroleum sulfonates as a portion of or as all of the surfactant. Examples of petroleum sulfonates include sulfonates from whole crude oil, topped crude oil, wherein a portion of the light ends of the crude oil having a boiling point less than 315° C. has been removed, semirefined and refined fractions of crude oil.

The amount of surfactant contained in the produced crude oil is dependent upon the surfactant formulation used, the reservoir, and the stage or maturity of the oil recovery process. Generally, the crude oils produced by surfactant floods may contain from traces to about 50% surfactant. Lower concentrations of surfactant do not render the crude oil unsuitable for conventional transportation or refining techniques.

In the process of the invention the middle phase emulsion (MPE) is first subjected to atmospheric distillation, followed by vacuum distillation. These sequential distillation steps result in a gravity separated two-phase distillate in the case of atmospheric distillation, and a single phase distillate in the case of the subsequent vacuum distillation. The atmospheric distillate contains both oil and water, which may be gravitationally separated into phases. The vacuum distillate contains essentially only oil. The distillation residue contains the sulfonate surfactant, which may then be recovered.

The first step is an atmospheric distillation preferably carried out as a steam distillation. This steam distillation is initially carried out at a reactor or pot temperature of approximately 212° F. (100° C.), as this is the boiling point of water. In this procedure, a distillation plateau will be maintained at this temperature for some period of time. The atmospheric or steam distillation should then be continued until a reactor or pot temperature of approximately 400° F. (204.4° C.) is reached. At this point, the atmospheric distillation should be discontinued, and the apparatus cooled. This atmospheric distillation removes most of the water from the emulsion together with some oil to provide a two phase distillate. The purpose of this atmospheric distillation is to remove as much of the water as possible from the mixture. The reflux ratio is preferably about 1:1. While some oil will be distilled over in this step, the majority of the distillate will be water.

After completion of the atmospheric or steam distillation, the remaining residue, containing primarily oil and surfactant is then subjected to vacuum distillation, thus providing sequential distillation steps. In this step, the oil is distilled away from the surfactant which remains as the final residue. The vacuum distillation is conducted to a final reactor temperature of up to 600° C. (315.5° C.), and under a column vacuum ranging from about 2.0 to 15.0 mm of mercury. In this distillation, the separation of oil and surfactant is sufficiently sharp that the oil is recovered in reusable form and the surfactant is recovered in suitable purity for reuse as a surfactant in this process.

As a result of these sequential distillation separations, the three phase emulsion is effectively separated into its three essential components. Further, the valuable components, the oil and surfactant, are recovered in a form suitable for sale or reuse. Thus, the present invention provides a simple and effective method for the separation and recovery of these useful and valuable components.

The following example is presented to illustrate the invention, but it is not to be considered as limited thereto. In the example and throughout the specification, parts are by weight unless otherwise indicated.

EXAMPLE 1

Fluids produced from an enhanced oil recovery well were allowed to gravity separate, resulting in a three phase system:

1. Top phase oil
2. Middle phase emulsion (MPE)
3. Lower brine phase.

The MPE was separated and analyzed, and the composition was determined to be:

25% water
25% petroleum sulfonate
50% oil.

2000 milliliters of the MPE was subjected first to atmospheric distillation, resulting in a gravity separated two phase distillate consisting of 207 ml oil and 345 ml water. The atmospheric distillation was followed by a vacuum distillation under column vacuum ranging from 2.25 to 6.3 mm Hg with each fraction or cut being about 50 cc's. The following table sets forth the actual vacuum distillation data:

| Vacuum Cut # | P (mm of Hg) | Pot T (°F.) | Overhead T (°F.) |
|---|---|---|---|
| 1 | 2.25 | 222 | 128 |
| 2 | 2.13 | 263 | 147 |
| 3 | 2.24 | 302 | 183 |
| 4 | 2.15 | 373 | 236 |
| 5 | 2.69 | 405 | 269 |
| 6 | 2.10 | 440 | 308 |
| 7 | 2.18 | 491 | 355 |
| 8 | 4.05 | 549 | 434 |
| 9 | 6.3 | 595 | 482 |

The vacuum distillation resulted in a single phase distillate. Compositional analysis of the distillations were:

| Distillation | Maximum Overhead Temperatures (°F.) | Oil (ML) | Water (ML) |
|---|---|---|---|
| Atmospheric | 185 | 207 | 345 |
| Vacuum | 480 | 511 | 2 |

The resulting residue had a density of 1.0 gm/cc, and a volume of 615 ml.

Sulfur analysis of the various materials indicated that essentially all of the original sulfur present in the MPE was present in the residue after distillation. Only trace amounts of sulfur were found in the oil and water phases. Therefore, the sulfonate was not decomposed in the process and remains concentrated in the residue.

Compositional analysis of the original MPE can be derived from the measured volumes of the various components recovered in the described distillation process.

| Material | Composition Based On Original Charge (%) | Composition Based On Recovered Product (%) |
|---|---|---|
| Water | 17 | 21 |
| Oil | 36 | 43 |
| Sulfonate | 31 | 36 |
| Loss | 16 | — |

These results indicate that the distillation procedure described can resolve the MPE into components that are of commercial value, and a water phase which may be disposed in an environmentally safe manner.

The invention has been described herein with reference to certain preferred embodiments. However, as obvious variations thereon will become apparent to those skilled in the art, the invention is not to be considered as limited thereto.

What is claimed is:

1. A method for the separation and recovery of the water, oil and surfactants contained in a middle phase emulsion, which comprises distilling the emulsion under conditions of atmospheric distillation to separate the water from a residue comprising the oil and surfactant, and thereafter subjecting the residue to vacuum distillation to separate the oil as a distillate and recover the surfactant as the distillation residue.

2. A method according to claim 1 wherein the atmospheric distillation is steam distillation.

3. A method according to claim 1 wherein the surfactant is selected from the group consisting of nonionic surfactants and cationic surfactants.

4. A method according to claim 1 wherein the emulsion comprises about 10 to 50 wt. % of water, about 10 to 50 wt. % of oil and from a trace up to about 50 wt. % of surfactant.

5. A method according to claim 1 wherein the atmospheric distillation is carried out until the distillation reactor temperature reaches 400° F.

6. A method according to claim 1 wherein the vacuum distillation is carried out until the distillation reactor temperature reaches 600° F. and under a column pressure ranging from about 2.0 to 15.0 mm mercury.

7. A method according to claim 1 wherein the surfactant is a petroleum sulfonate.

8. A method for recovering the oil, water and surfactants from a middle phase emulsion containing these components which comprises:

(a) subjecting said emulsion to atmospheric distillation with the introduction of steam to distill water from the mixture and provide a distillation residue comprising oil and surfactant;

(b) subjecting said distillation residue to vacuum distillation to distill the oil as distillate and recover the surfactant as distillation residue.

9. A method according to claim 8 wherein the surfactant is a petroleum sulfonate.

* * * * *

UNITED STATES PATENT AND TRADEMARK OFFICE

CERTIFICATE OF CORRECTION

PATENT NO. : 4,623,447

DATED : November 18, 1986

INVENTOR(S) : Clampitt et al

It is certified that error appears in the above-identified patent and that said Letters Patent is hereby corrected as shown below:

On the title page
The inventorship is amended to include

--Clifford G. Venier, The Woodlands, Texas--.

Signed and Sealed this

Seventeenth Day of February, 1987

*Attest:*

*Attesting Officer*

DONALD J. QUIGG

*Commissioner of Patents and Trademarks*